US008950722B2

(12) United States Patent
Duncan

(10) Patent No.: US 8,950,722 B2
(45) Date of Patent: Feb. 10, 2015

(54) CHRISTMAS TREE STAND AND KIT THEREFOR

(71) Applicant: Galyna Duncan, Oshawa (CA)

(72) Inventor: Galyna Duncan, Oshawa (CA)

( * ) Notice: Subject to any disclaimer, the term of this patent is extended or adjusted under 35 U.S.C. 154(b) by 0 days.

(21) Appl. No.: 14/084,666

(22) Filed: Nov. 20, 2013

(65) Prior Publication Data

US 2014/0151526 A1 Jun. 5, 2014

Related U.S. Application Data

(60) Provisional application No. 61/731,791, filed on Nov. 30, 2012.

(51) Int. Cl.
*F16M 13/00* (2006.01)

(52) U.S. Cl.
USPC ..... 248/523; 248/511; 248/519; 248/527

(58) Field of Classification Search
CPC ..... A47G 33/1213; A47G 33/1206; A47G 2033/1286
USPC ..... 248/519, 523, 527; 47/40.5; 254/223, 254/213, 227
See application file for complete search history.

(56) References Cited

U.S. PATENT DOCUMENTS 5,398,444 A * 3/1995 Murray ..... 47/40.5
7,044,427 B2 * 5/2006 Eckenswiller ..... 248/523
7,600,342 B2 * 10/2009 Fiveash ..... 47/40.5

* cited by examiner

*Primary Examiner* — Amy J Sterling

(57) ABSTRACT

A Christmas tree stand comprises a container having a base and a sidewall extending therefrom, the sidewall having a plurality of outer longitudinal slots; a plurality of removable legs, each removable leg configured to be accommodated within a respective longitudinal slot; and a plurality of grippers threadably connected to the sidewall. Each gripper has a flexible padding layer disposed thereon for securely gripping a trunk of a Christmas tree.

16 Claims, 4 Drawing Sheets

CHRISTMAS TREE STAND AND KIT THEREFOR

CROSS-REFERENCE TO RELATED APPLICATIONS

This application claims the benefit of U.S. application Ser. No. 61/731,791 filed on Nov. 30, 2012, the content of which is incorporated by reference herein in its entirety.

FIELD OF THE INVENTION

The present invention relates generally to supports for trees and in particular, to a Christmas tree stand.

BACKGROUND OF THE INVENTION

Tree stands are used for supporting real or artificial Christmas trees. Previously described stands typically include, for example, a container for receiving the lower end of the trunk of the tree, and a plurality of support members connected to the container and having attachments affixed thereto for engaging and supporting the trunk of the tree. Often, the attachments are simple in design, and comprise a rigid metal spike for engaging and supporting the tree.

Tree stands having removable support members have been described. For example, U.S. Pat. No. 3,719,340 to Norton discloses a tree stand comprising a spider support for supporting a standard, such as for example an artificial Christmas tree, having a central hub including a receptacle therein and a fence integral with and in spaced relation thereto. The fence has spaced slots which receive removably installable anchors of spoke elements extending in radial relation to the hub; the hub and spoke elements co-operating to provide a rigid assembly.

Tree stands comprising attachments for engaging and supporting the trunk of the tree, and which are shaped to conform to the contour of the trunk, have also been described. For example, tree stands comprising such attachments are described in U.S. Pat. No. 4,007,901 to Mancini et al., U.S. Pat. No. 4,825,586 to Coppedge, and U.S. Pat. No. 4,967,508 to Reynolds.

In at least some known Christmas tree stands, the attachments do not have provisions for securely gripping the trunk of the tree. As will be appreciated, such a deficiency can be problematic, as the trunks of natural trees are typically uneven and have surface irregularities. Moreover, the trunks of some artificial trees having a "life-like" design are also uneven and have surface irregularities.

Improvements are generally desired. It is therefore an object of the present invention to provide an improved and novel Christmas tree stand.

SUMMARY OF THE INVENTION

It is an object of the invention to provide a Christmas tree stand having grippers configured for firmly and securely gripping a tree trunk regardless of any surface irregularities thereon, by being able to readily conform to such surface irregularities.

Other objects of the invention are to provide a Christmas tree stand that is easy to use such that it may be assembled and disassembled by only one person; to provide a Christmas tree stand that can be disassembled such that it can be readily packaged into a small box; to provide a Christmas tree stand configured for providing suitable support of the tree while enabling water to access the base of the trunk; to provide a Christmas tree stand configured for accommodating a saucer underneath for preventing spilled water from contacting or damaging a support surface beneath the Christmas tree stand, such as for example a floor; and to provide a Christmas tree stand configured for reducing shifting of the trunk against a base of a container thereof, so as to provide stability to the tree.

Accordingly, in one aspect there is provided a Christmas tree stand comprising: a container having a base and a sidewall extending therefrom, the sidewall having a plurality of outer longitudinal slots; a plurality of removable legs, each removable leg configured to be accommodated within a respective longitudinal slot; and a plurality of grippers threadably connected to the sidewall, each gripper having a flexible padding layer disposed thereon for securely gripping a trunk of a Christmas tree.

Each gripper may comprise a threaded shaft joined to a gripper member by a ball and socket joint. The gripper member may comprise an arcuate rigid portion on which the flexible padding layer is disposed.

The Christmas tree stand may further comprise a plurality of removable pads, each pad being configured to be positioned on a respective removable leg, and each pad being fabricated of a resilient material for providing an anti-slip surface.

The Christmas tree stand may further comprise a plurality of threaded inserts mounted within the container for accommodating the grippers. The threaded inserts may have a thread dimension that is generally matched to a thread dimension of the grippers.

The Christmas tree stand may further comprise a support plate comprising an array of spikes extending therefrom. Each spike may be terminated by a point that is sufficiently dull so as to not significantly penetrate the trunk of the tree when the weight of the tree is fully supported by the array of spikes.

Each removable leg may comprise a lateral portion and a bracket portion, the lateral portion being offset from an upper end of the bracket portion by an offset distance.

In another aspect, there is provided a kit for a Christmas tree stand comprising: a container having a base and a sidewall extending therefrom, the sidewall having a plurality of outer longitudinal slots; a plurality of removable legs, each removable leg configured to be accommodated within a respective longitudinal slot; and a plurality of grippers, each gripper being configured to be threadably connected to the sidewall, each gripper having a flexible padding layer disposed thereon for securely gripping a trunk of a Christmas tree.

Each gripper may comprise a threaded shaft joined to a gripper member by a ball and socket joint. The gripper member may comprise an arcuate rigid portion on which the flexible padding layer is disposed.

The kit may further comprise a plurality of removable pads, each pad being configured to be positioned on a respective removable leg, and each pad being fabricated of a resilient material for providing an anti-slip surface.

The container may have a plurality of threaded inserts mounted therein for accommodating the grippers. The threaded inserts may have a thread dimension that is generally matched to a thread dimension of the grippers.

The kit may further comprise a support plate comprising an array of spikes extending therefrom. Each spike may be terminated by a point that is sufficiently dull so as to not significantly penetrate the trunk of the tree when the weight of the tree is fully supported by the array of spikes.

Each removable leg may comprise a lateral portion and a bracket portion, the lateral portion being offset from an upper end of the bracket portion by an offset distance.

BRIEF DESCRIPTION OF THE DRAWINGS

Embodiments will now be described more fully with reference to the accompanying drawings in which.

DETAILED DESCRIPTION OF THE EMBODIMENTS

Figure 1:
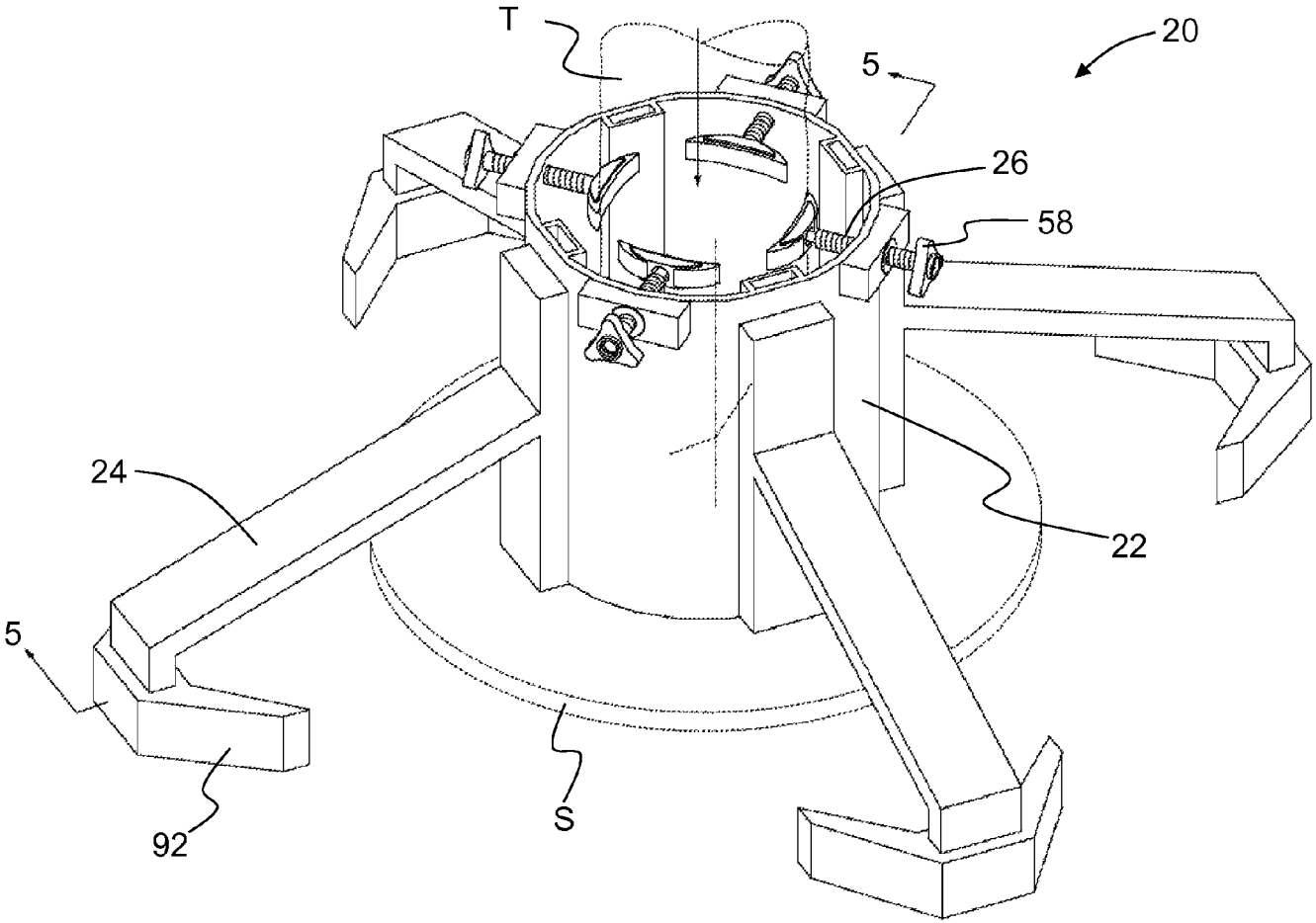
FIG. 1 is a perspective view of a Christmas tree stand.
Figure 2:
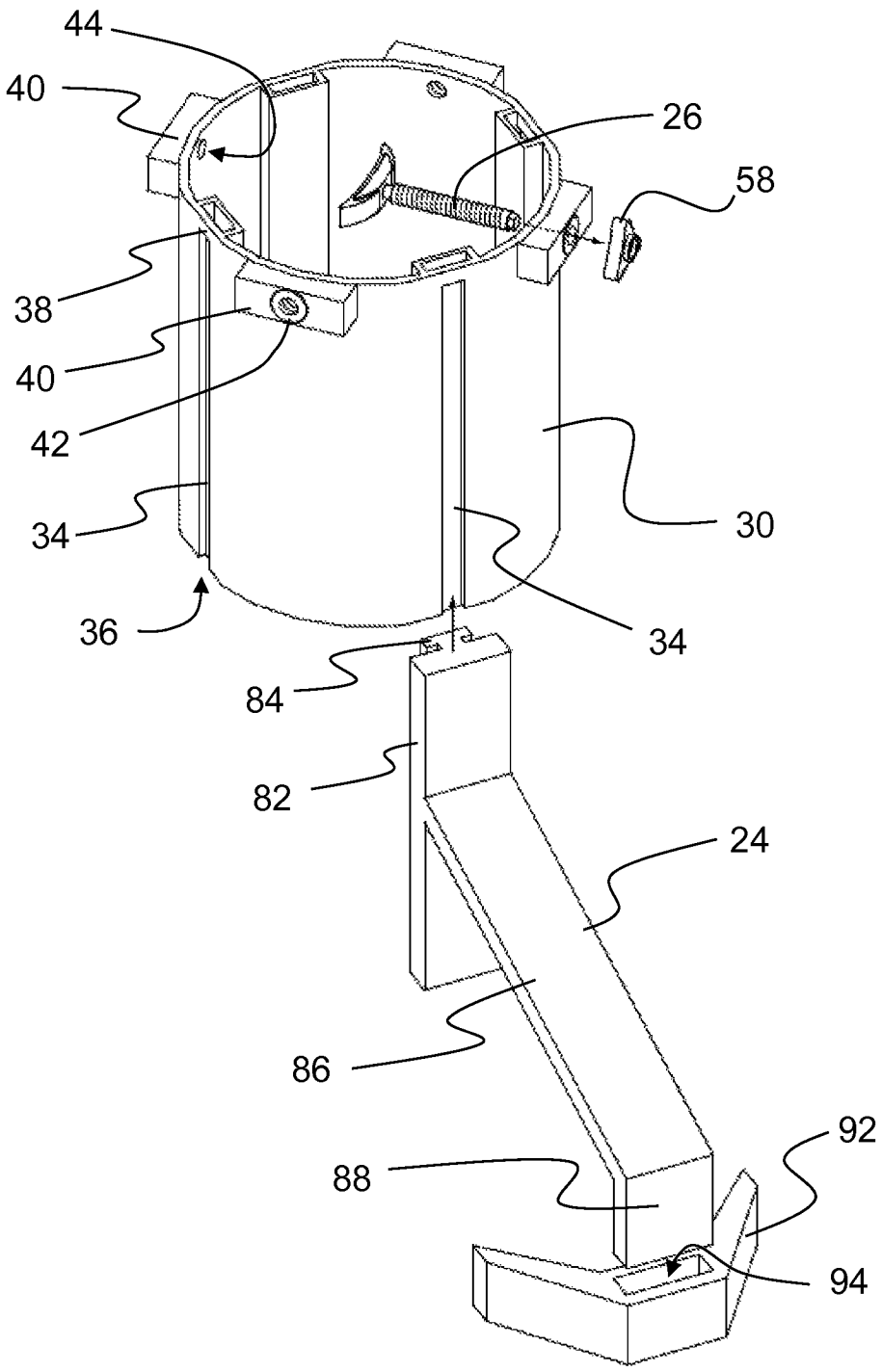
FIG. 2 is an exploded perspective view of a portion of the Christmas tree stand of FIG. 1.

Turning now to FIGS. 1 to 5, a Christmas tree stand is shown and is generally indicated by reference numeral 20. Christmas tree stand 20 comprises a hollow container 22 that is configured to be supported by a plurality of removable legs 24. The tree stand 20 further comprises a plurality of grippers 26 installed in the container 22, with each gripper 26 comprising a flexible padding layer fabricated of a resilient material for securely gripping a natural or artificial Christmas tree positioned therein.

In the embodiment shown, the container 22 has a generally cylindrical shape, and comprises a base 28 and a sidewall 30 extending therefrom. At an opposite end of the container 22 from the base 28 is an opening 32, for receiving a trunk T of a natural or artificial tree. The sidewall 30 has a plurality of slots 34 that extend in an axial direction along an outer surface thereof. Each slot 34 has an opening 36 adjacent the base 28 for receiving a removable leg 24. At an opposite end of each slot 34 is a stop 38, which provides a surface against which the removable leg 24 abuts once it has been fully inserted into the slot 34.

The container 22 also comprises a plurality of blocks 40 disposed on the outer surface of the sidewall 30, and proximate the opening 32. Each block 40 comprises a cavity housing a threaded insert 42 that is formed separately from the container 22 and block 40. The threaded insert 42 is concentrically aligned with a non-threaded bore 44 through the sidewall 30. The threaded insert 42 and non-threaded bore 44 are configured for accommodating the gripper 26.

Figure 3:
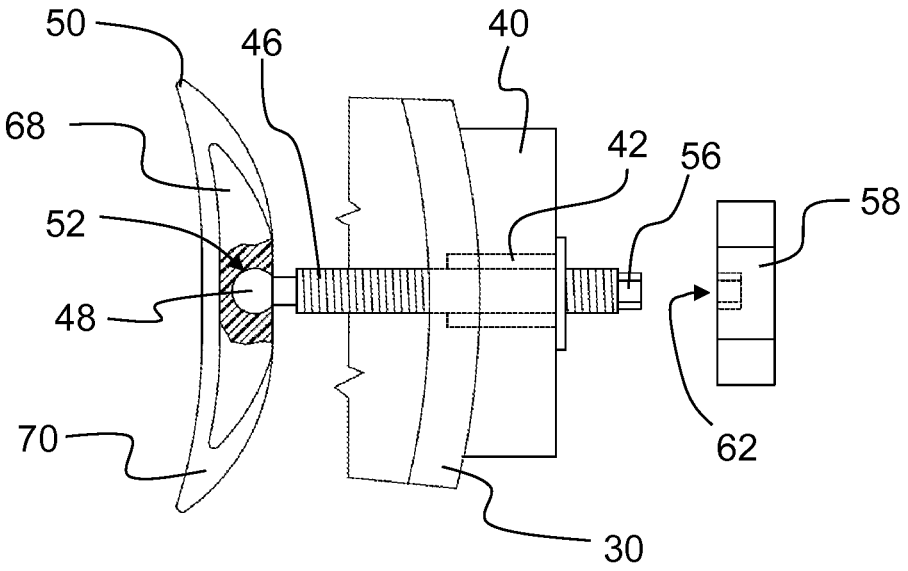
FIGS. 3 and 4 are exploded top and top views, respectively, of another portion of the Christmas tree stand of FIG. 1.
Figure 4:
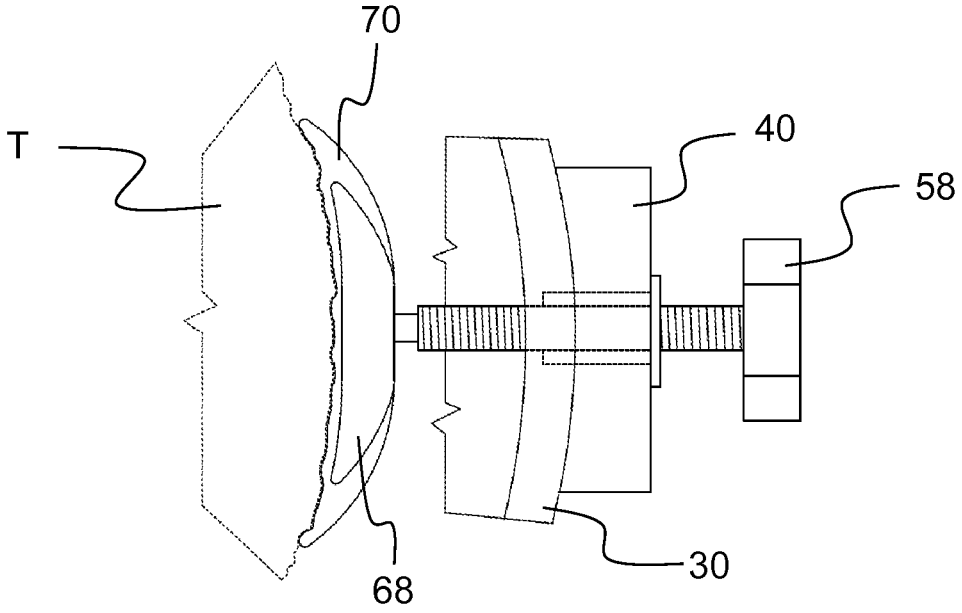

The gripper 26 may be better seen in FIGS. 3 and 4. Each gripper 26 comprises an elongate threaded shaft 46 having a spherical member 48 disposed at one end thereof. The threaded shaft 46 is rotatably connected to a gripper member 50 via a generally spherical socket 52, which cooperates with the spherical member 48 to form a ball and socket joint. The threaded shaft 46 has a large diameter, and is fabricated of a material having high strength and high wear resistance. In this embodiment, the threaded shaft 46 is fabricated of nylon. As will be understood, the large diameter of the threaded shaft 46 allows stress to be distributed over a larger thread area, and the high strength and high wear resistance material of the threaded shaft 46 increases the resistance of its threads to stripping, both of which prolong the service life of the gripper 26. As will be appreciated, the reduced stress on the thread area allows the threaded shaft 46 to be easily rotated, which advantageously allows the gripper member 50 to be easily adjusted and with little applied rotational force. Additionally, and as will be appreciated, the threaded insert 42 may be selected such that its thread dimensions accurately match the thread dimensions of the threaded shaft 46. As a result of this thread dimension matching, the tendency of threads of the threaded shaft 46 to become stripped is reduced. As will be understood by those skilled in the art, such thread dimension matching might not otherwise be achievable if no threaded inserts 42 were used, and if the bore 44 was replaced by a threaded bore formed during fabrication of the container 22; in such a scenario, thread dimensions of such a threaded bore would be subject to manufacturing variance, and consistent thread dimension matching would be difficult.

At an opposite end of the threaded shaft 46 from the spherical member 48 is disposed a hexagonal nut 56. Each gripper 26 further comprises a removable handle 58 having a corresponding hexagonally-shaped cavity 62 shaped to accommodate the hexagonal nut 56 of the threaded shaft 46. When installed on the hexagonal nut 56, the handle 58 is configured to be rotated by a user for advancing or retracting the gripper member 50, as desired.

Each gripper member 50 comprises an arcuate rigid portion 68, and a flexible padding layer 70 disposed on the rigid portion 68 so as to define a resilient, concave gripping surface. In this embodiment, the flexible padding layer 70 is sized to extend at least the length of the rigid portion 68, and has an arcuate shape that generally matches the shape of the arcuate rigid portion 68. Additionally, in this embodiment, the concave gripping surface is smooth. The flexible padding layer 70 is fabricated of a durable, resilient material that can advantageously conform to the surface of the trunk T of the tree as the gripper member 50 is advanced towards the trunk T, and regardless of any surface irregularities of the trunk T. As will be understood, the flexible padding layer 70 enables the gripper 26 to firmly grip the trunk T of generally any natural or artificial tree of suitable size positioned in the container 22. In this embodiment, the flexible padding layer 70 is fabricated of rubber.

Figure 5:
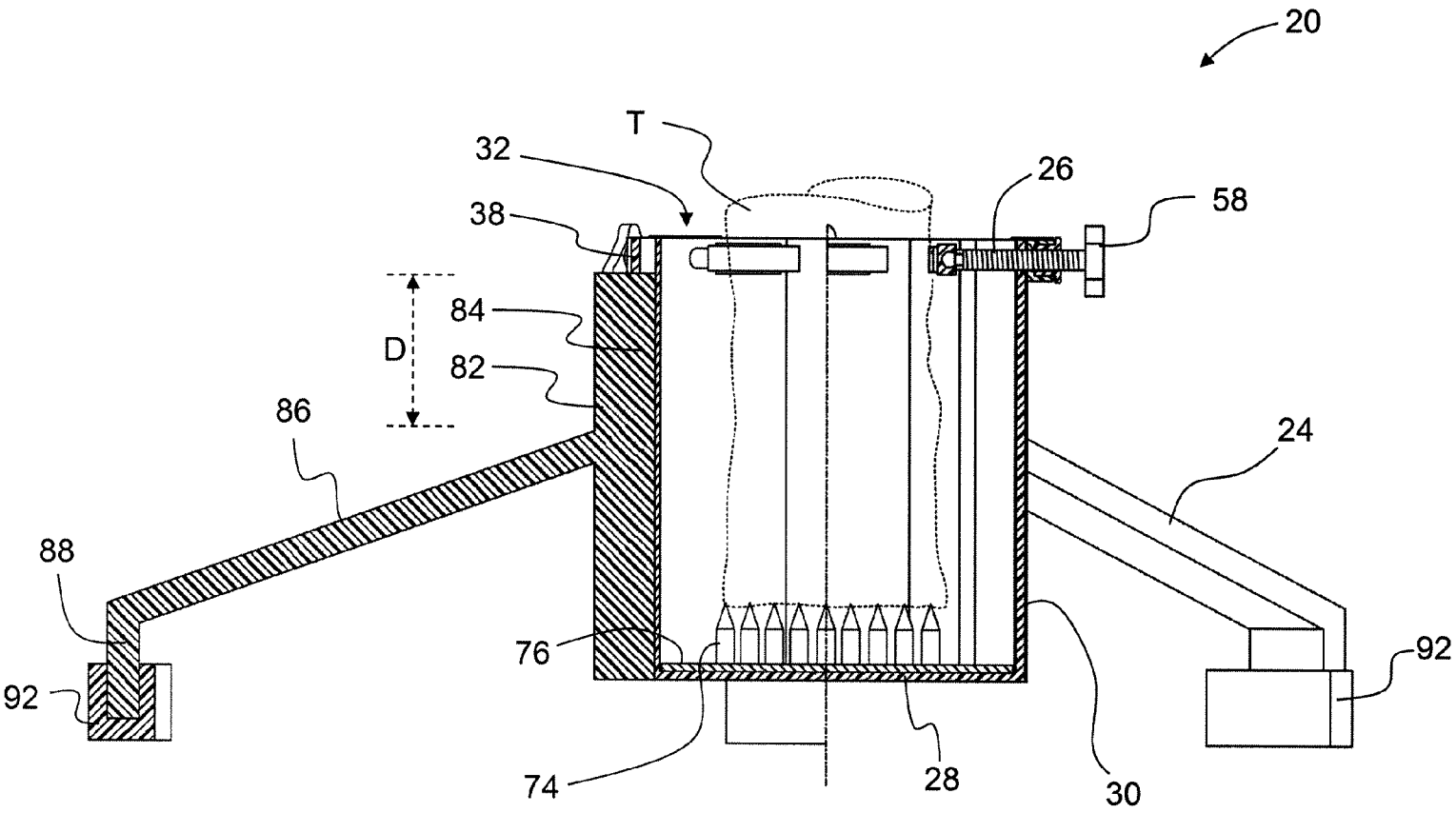
FIG. 5 is a sectional side view of the Christmas tree stand of FIG. 1, taken along the indicated section line.

The tree stand 20 further comprises a support plate 74 having an array of spikes 76 extending therefrom, and which is sized to be placed in the interior of the container 22 against the base 28, as shown in FIG. 5. The support plate 74 is fabricated of a material that will not corrode under normal operating conditions, and in this embodiment the support plate 74 is fabricated of nylon. The array of spikes 76 is configured to provide an elevated support for the trunk T, such that the base of the trunk T is spaced from the base 28 of the container 22 for allowing water to enter the base of the trunk T for hydrating the tree. Each spike 76 is terminated by a point that is sufficiently dull so as to not significantly penetrate the trunk T when the weight of the tree is fully supported by the array of spikes 76 during use. As will be appreciated, as the trunk T is not significantly penetrated by the spikes 76, the tree may be easily separated from the support plate 74, allowing the tree to be easily repositioned within the tree stand 20 during installation. Additionally, as the trunk T is not significantly penetrated by the array of spikes 76, the tree may be easily removed from the tree stand 20, and without having to apply significant force to the tree or to the tree stand 20. In this embodiment, the support plate 74 is separate from the container 22, and is therefore not affixed to or integral with the container 22. As will be understood, this advantageously allows the support plate 74 to be replaced as necessary, for example if damaged, and without requiring replacement of the container 22 or the tree stand 20.

The removable legs 24 are configured to be inserted into the slots 34 during assembly of the tree stand 20. Each removable leg 24 comprises a bracket portion 82 having a longitudinal key 84 disposed thereon. The bracket portion 82 and the longitudinal key 84 are shaped to cooperate with the longitudinal slot 34, for enabling the removable leg 24 to be removably attached to the container 22. The removable leg 24 further comprises a lateral portion 86 extending outwardly from the bracket portion 82, and which is terminated by a downturned portion 88 disposed at an end thereof. In the embodiment shown, the lateral portion 86 extends from near the midpoint of the bracket portion 82, and is offset from an upper end of the bracket portion 82 by an offset distance D. As will be understood, when the tree stand 20 is assembled, the lateral portions 86 are positioned relatively near to the support surface, such as for example a floor (not shown), and are distant from lowermost branches (not shown) of the tree. As a result, the shape of the removable legs 24 allows a skirt (not shown) to be easily placed over the lateral portions 86 of the legs 24, and provides a space in which presents may be accommodated under the tree, and adjacent the container 22 and above the lateral portions 86. Additionally, the shape of the removable legs 24 also allows a saucer S to be accommodated within the legs 24, and beneath the container 22, for preventing spilled water from contacting or damaging the support surface.

A removable pad 92 may be disposed on an end of each downturned portion 88, as desired. Each removable pad 92 comprises an aperture 94 that is sized to receive the downturned portion 88. Each removable pad 92 is fabricated of a resilient material for providing an anti-slip surface, and in this embodiment each removable pad 92 is fabricated of rubber. Each removable pad 92 is larger in size than the footprint of the downturned portion 88. As a result, the removable pads 92 increase the total area of contact between the legs 24 and the support surface, so as to advantageously distribute the weight of the tree and the tree stand 20 over a larger area. As will be understood, this distribution of weight advantageously reduces pressure imposed by the tree stand 20 and the tree on the support surface, and thereby reduces the likelihood of damage to the support surface. Additionally, the pads 92 improve the aesthetic appearance of the tree stand 20, in the event that no skirt is used. In the embodiment shown, each pad 92 has a general "V" shape.

In use, the tree stand 20 is assembled by placing the support plate 74 into the bottom of the container 22, with spikes 76 oriented towards the opening 32 of the container 22. The grippers 26 are then installed by inserting the hexagonal nut 56 of each gripper 26 into the bore 44 from the interior of the container 22, and rotating the gripper 26 until it is fully retracted such that the gripper member 50 abuts the inner surface of the sidewall 30 of the container 22. A handle 58 may be fitted to the gripper 26 once the hexagonal nut 56 protrudes sufficiently from the block 40.

The container 22 having the grippers 26 installed therein is then secured to the trunk T of a tree by first laying the tree horizontally on a support surface, such as for example a floor. The container 22 is then fitted onto an end of the trunk T, such that the base of the trunk T abuts the support plate 74 in the container 22. The positions of the gripper members 50 are then advanced towards the trunk T by fitting the handles 58 to the grippers 26, if not already fitted, and turning the handles 58 in the appropriate direction. As the gripper members 50 come into contact with the trunk T, the flexible padding layers 70 of the gripper members 76 resiliently conform to any surface irregularities on the trunk T. The gripper members 50 may be continued to be advanced until the tree is firmly secured, as desired. The removable legs 24 are then installed by inserting the key 84 into the opening 36 of a slot 34, and sliding the leg 24 into the slot 34 so as to abut against the stop 38. The removable pads 92 may be installed on the downturned portions 88 of the legs 24, as desired. The tree, together with the assembled tree stand 20 secured thereto, is then lifted from the support surface to a generally vertical orientation. The tree may be repositioned to adjust its position within the container 22, as desired, by advancing or retracting one or more grippers 26 using the handles 58. A saucer S may be placed beneath the container 22, and within the legs 24, as desired, for preventing spilled water from contacting or damaging the support surface.

As will be appreciated, the Christmas tree stand is generally easy to use, and may be assembled and secured to the trunk of a tree in a facile manner by a single person of modest height. Additionally, and as will be appreciated, the tree stand can be disassembled into parts for placement in a relatively small box for shipment and sale, for example. Furthermore, the parts of the tree stand, and namely the removable legs, the grippers and the removable pads, are sized to be generally nested within the container, allowing the disassembled Christmas tree stand to be stored in a compact manner. As will be appreciated, the Christmas tree stand has a generally simple design, and may be manufactured for relatively low cost.

Additionally, the shape of the removable legs and the container advantageously accommodate a saucer to be placed beneath the container, and within the legs, for advantageously preventing spilled water from contacting or damaging the support surface.

Although in the embodiment described above, the threaded shaft is fabricated of nylon, the threaded shaft is not limited to this material, and in other embodiments may alternatively be fabricated of any other suitable material having high strength and high wear resistance.

Although in embodiment described above, the support plate is fabricated of nylon, the support plate is not limited to this material, and in other embodiments may alternatively be fabricated of any other suitable material that will not corrode under normal operating conditions.

Although in embodiment described above, the flexible padding layer is fabricated of rubber, the flexible padding layer is not limited to this material, and in other embodiments may alternatively be fabricated of any other suitable durable, resilient material that can conform to the surface of the trunk T of the tree as the gripper member is advanced towards the trunk T, and regardless of any surface irregularities.

Although in embodiment described above, the removable pad is fabricated of rubber, the removable pad is not limited to this material, and in other embodiments may alternatively be fabricated of any other suitable resilient material for providing an anti-slip surface for supporting the tree stand.

Although in the embodiment described above, the support plate is separate from the container and is not affixed to or integral therewith, in other embodiments, the support plate may alternatively be affixed to and/or integral with the container.

The invention also contemplates a kit for the embodiment(s) of the Christmas tree stand described above.

Although embodiments have been described above with reference to the accompanying drawings, those of skill in the art will appreciate that variations and modifications may be made without departing from the scope thereof as defined by the appended claims.

What is claimed is:

1. A Christmas tree stand comprising:

a container having a base and a sidewall extending therefrom, the sidewall having a plurality of outer longitudinal slots;

a plurality of removable legs, each removable leg configured to be accommodated within a respective longitudinal slot; and a plurality of grippers threadably connected to the sidewall, each gripper having a flexible padding layer disposed thereon for securely gripping a trunk of a Christmas tree, wherein each gripper comprises a threaded shaft joined to a gripper member by a ball and socket joint.

2. The Christmas tree stand of claim 1, wherein the gripper member comprises an arcuate rigid portion on which the flexible padding layer is disposed.

3. The Christmas tree stand of claim 1, further comprising a plurality of removable pads, each pad being configured to be positioned on a respective removable leg, and each pad being fabricated of a resilient material for providing an anti-slip surface.

4. The Christmas tree stand of claim 1, further comprising a plurality of threaded inserts mounted within the container for accommodating the grippers.

5. The Christmas tree stand of claim 4, wherein the threaded inserts have a thread dimension that is generally matched to a thread dimension of the grippers.

6. The Christmas tree stand of claim 1, further comprising a support plate comprising an array of spikes extending therefrom.

7. The Christmas tree stand of claim 6, wherein each spike is terminated by a point that is sufficiently dull so as to not significantly penetrate the trunk of the tree when the weight of the tree is fully supported by the array of spikes.

8. The Christmas tree stand of claim 1, wherein each removable leg comprises a lateral portion and a bracket portion, the lateral portion being offset from an upper end of the bracket portion by an offset distance.

9. A kit for a Christmas tree stand comprising:

a container having a base and a sidewall extending therefrom, the sidewall having a plurality of outer longitudinal slots;

a plurality of removable legs, each removable leg configured to be accommodated within a respective longitudinal slot; and a plurality of grippers, each gripper being configured to be threadably connected to the sidewall, each gripper having a flexible padding layer disposed thereon for securely gripping a trunk of a Christmas tree, wherein each gripper comprises a threaded shaft joined to a gripper member by a ball and socket joint.

10. The kit of claim 9, wherein the gripper member comprises an arcuate rigid portion on which the flexible padding layer is disposed.

11. The kit of claim 9, further comprising a plurality of removable pads, each pad being configured to be positioned on a respective removable leg, and each pad being fabricated of a resilient material for providing an anti-slip surface.

12. The kit of claim 9, wherein the container has a plurality of threaded inserts mounted therein for accommodating the grippers.

13. The kit of claim 12, wherein the threaded inserts have a thread dimension that is generally matched to a thread dimension of the grippers.

14. The kit of claim 9, further comprising a support plate comprising an array of spikes extending therefrom.

15. The kit of claim 14, wherein each spike is terminated by a point that is sufficiently dull so as to not significantly penetrate the trunk of the tree when the weight of the tree is fully supported by the array of spikes.

16. The kit of claim 9, wherein each removable leg comprises a lateral portion and a bracket portion, the lateral portion being offset from an upper end of the bracket portion by an offset distance.

* * * * *